US007207426B2

(12) United States Patent
Godshaw et al.

(10) Patent No.: US 7,207,426 B2
(45) Date of Patent: Apr. 24, 2007

(54) COMBINATION DUFFLE AND GARMENT BAG

(75) Inventors: Donald E. Godshaw, Evanston, IL (US); Andrezj M. Redzisz, Wheeling, IL (US)

(73) Assignee: Travel Caddy, Inc., Elk Grove Village, IL (US)

( * ) Notice: Subject to any disclaimer, the term of this patent is extended or adjusted under 35 U.S.C. 154(b) by 0 days.

(21) Appl. No.: 11/121,212

(22) Filed: May 3, 2005

(65) Prior Publication Data

US 2006/0266603 A1 Nov. 30, 2006

(51) Int. Cl.
*A45C 9/00* (2006.01)
*A45C 13/26* (2006.01)

(52) U.S. Cl. ..... 190/1; 190/107; 190/901; 190/903; 206/278; 206/387; 383/4

(58) Field of Classification Search ..... 190/107, 190/901, 1, 2; 206/278, 279, 284, 287, 290, 206/292; 383/4
See application file for complete search history.

(56) References Cited

U.S. PATENT DOCUMENTS 2,254,578 A * 9/1941 O'Brien ..... 190/107
3,777,862 A * 12/1973 Zipper ..... 190/107
3,944,032 A * 3/1976 Samhammer et al. ..... 206/292
D242,658 S * 12/1976 Genaro et al. ..... D3/285
4,059,464 A * 11/1977 Geller et al. ..... 156/66
5,469,967 A * 11/1995 Boorady ..... 206/527
6,193,034 B1 * 2/2001 Fournier ..... 190/107
6,334,519 B1 * 1/2002 Tong ..... 190/107

FOREIGN PATENT DOCUMENTS

EP 0439420 A1 * 7/1991
JP 405130910 A * 5/1993

* cited by examiner

*Primary Examiner*—Sue A. Weaver
(74) *Attorney, Agent, or Firm*—Banner & Witcoff, Ltd.

(57) ABSTRACT

A luggage item is convertible from a duffle bag form to a garment bag form by disengaging duffle end panels from the lateral sides of the garment bag and folding those end panels against the inside of the garment bag. Various arrangements of handles and carry straps are disclosed which facilitate transport of the luggage item as a duffle bag or a garment bag.

26 Claims, 13 Drawing Sheets

COMBINATION DUFFLE AND GARMENT BAG

BACKGROUND OF THE INVENTION

In a principal aspect the present invention relates to an item of luggage and, more particularly, to an item of luggage which may be converted from a duffle bag to a garment bag, or vice versa.

Travelers often find themselves desirous of packing their belongings in a duffle bag which is a soft sided, generally tubular shaped bag that can be easily carried and typically stored in an overhead storage bin of an airplane, for example. On the other hand, often a traveler will desire to transport a suit or another garment in a garment bag which enables utilization of hangers and further which enables hanging of the bag from a hook or the like for ease of access. Further, a garment bag is very useful for maintaining a garment item, such as a suit on a hanger in a flat, unfolded condition. These two desires associated with travel often entail the necessity to carry multiple bags in situations where a single bag might be suitable for carrying the garments and associated items such as toiletries and the like.

Another factor relating to baggage choice involves display and shipping issues. For example, duffle bags may require a larger package for purposes of shipment and display at a point of sale. Thus, for various reasons, there has developed a desire to provide a bag or item of luggage having the capabilities of a duffle bag as well as a garment bag.

SUMMARY OF THE INVENTION

Briefly, the present invention comprises an item of luggage which is convertible between a duffle bag form to a garment bag form and vice versa. The luggage item is a soft sided luggage item and includes a garment bag having an outside panel and an inside panel joined to form a typical garment bag enclosure with a zipper access opening longitudinally arranged one panel, typically the inside panel. The inside panel further includes first and second duffle end panels affixed to the opposite sides of the garment bag at the top end thereof and joined thereto by a flexible hinge arrangement which enables the duffle end panels to be folded against the inside panel for purposes of storage. When the end panels are in the unfolded condition, however, a peripheral zipper or fastening device may be utilized to attach the outer edges of the garment bag to the outer edge of the duffle end panels. The length of the lateral or side outer edges of the garment bag is thus substantially equivalent to the outer peripheral edge dimension of the duffle end panels so that the end panels may be attached to the folded garment bag and thereby define a duffle bag enclosure. Various arrangements of fasteners, clips, hanger holders, handles and carry straps are also disclosed which enable carrying of the duffle bag or the garment bag.

Thus, it is an object of the invention to provide a luggage item convertible between a duffle bag form and a garment bag form.

Another object of the invention is to provide a luggage item convertible between a duffle bag form and garment bag form wherein each of the forms is generally a soft sided luggage item.

Another object of the invention is to provide a garment bag which includes various handles, carry straps and fasteners which enable its utilization as a garment bag that may be folded or maintained in a fully opened position.

A further object of the invention is to provide a duffle bag configuration wherein the lateral sides of the duffle bag are formed by a garment bag which is combined with duffle end panels that are removably attached to the lateral side edges of the garment bag.

Yet a further object of the invention is to provide a compact, rugged, inexpensive and easily used luggage item which is convertible between a form as a duffle bag and a garment bag.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

Figure 1:
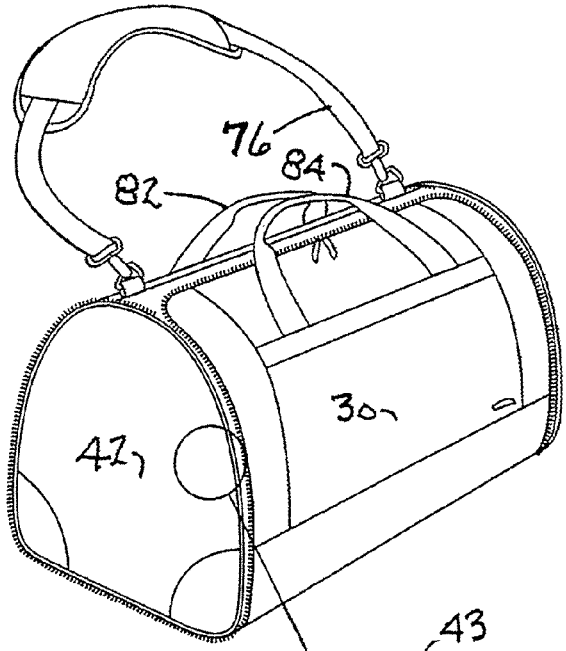
FIG. 1 is an isometric view of the luggage item of the invention configured as a duffle bag.

Referring to the figures, and in particular FIGS. 1–15, the luggage item of the invention is comprised of a garment bag having an outside panel 30 and an inside panel 32. Panels 30 and 32 are generally congruent in configuration and include a top side or top section 34, a lower or bottom side or section 36, a first lateral or side section 38 and a second lateral or side section 40. The luggage item further includes a first duffle end panel 42 and a second generally congruent, duffle end panel 44. The duffle end panels 42 and 44 are generally congruent in shape and typically are in the form of end panels of a duffle bag, i.e., circular, semi-circular, rounded and truncated, etc. That is, they may include a bottom generally straight side edge 46 and an arcuate side 48 which connects the opposite ends of the bottom side 46. In the preferred embodiment, the junction or connection between the outside panel 30 and the inside panel 32 includes a generally peripheral fastener 50 which extends from the top side 34 along first lateral side 38, bottom side 36 and second lateral side 40. In the preferred embodiment, the fastener 50 comprises a zipper mechanism, although other mechanisms may be used for purposes of fastening the various component elements together. Also in the preferred embodiment, the fastener along the peripheral outside edge; namely, the fastener 50 is preferably a single fastener such as a single zipper which may extend along a pathway entirely around the inside panel 32 as depicted in FIG. 5.

The first duffle end panel 42 also includes a peripheral fastener 52. The second duffle end panel 44 includes a peripheral fastener 54. Preferably, the fasteners 52 and 54 are components of zipper 50, though other fastener mechanisms may be used. The fastener 50 thus may extend in a closed loop entirely around the periphery of the inside panel 32. The fastener 50 includes a section 50*a* along lateral side 38, a section 50*b* along lateral side 36, and a section 50*c* along lateral side 40. The zipper or fastener pathway associated with the end panels 42 and 44 includes a starting section 46*a* which fits around the entire periphery of the first duffle end panel 46 and connects with an intermediate section 46*b* that runs along the top side 34 of the inside panel 32 and connects with the peripheral zipper section 54*a* along the outer periphery of the second duffle end panel 44. As mentioned, the preferential arrangement of the fasteners is a single zipper 50, for example, to connect the lateral side edges of the garment bag component panels 30, 32 with the duffle end panels 42 and 44.

Figure 4:
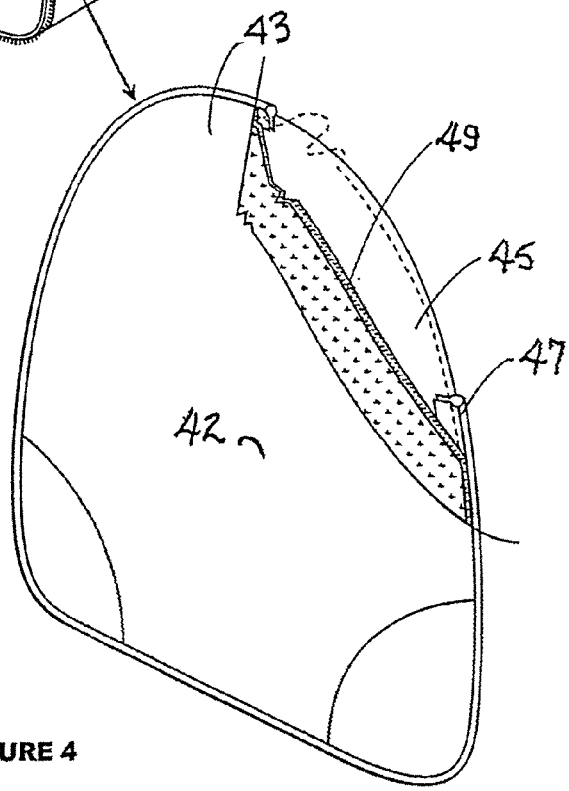
FIG. 4 is an enlarged isometric view of an end panel of the duffle bag form of the invention.
Figure 5:
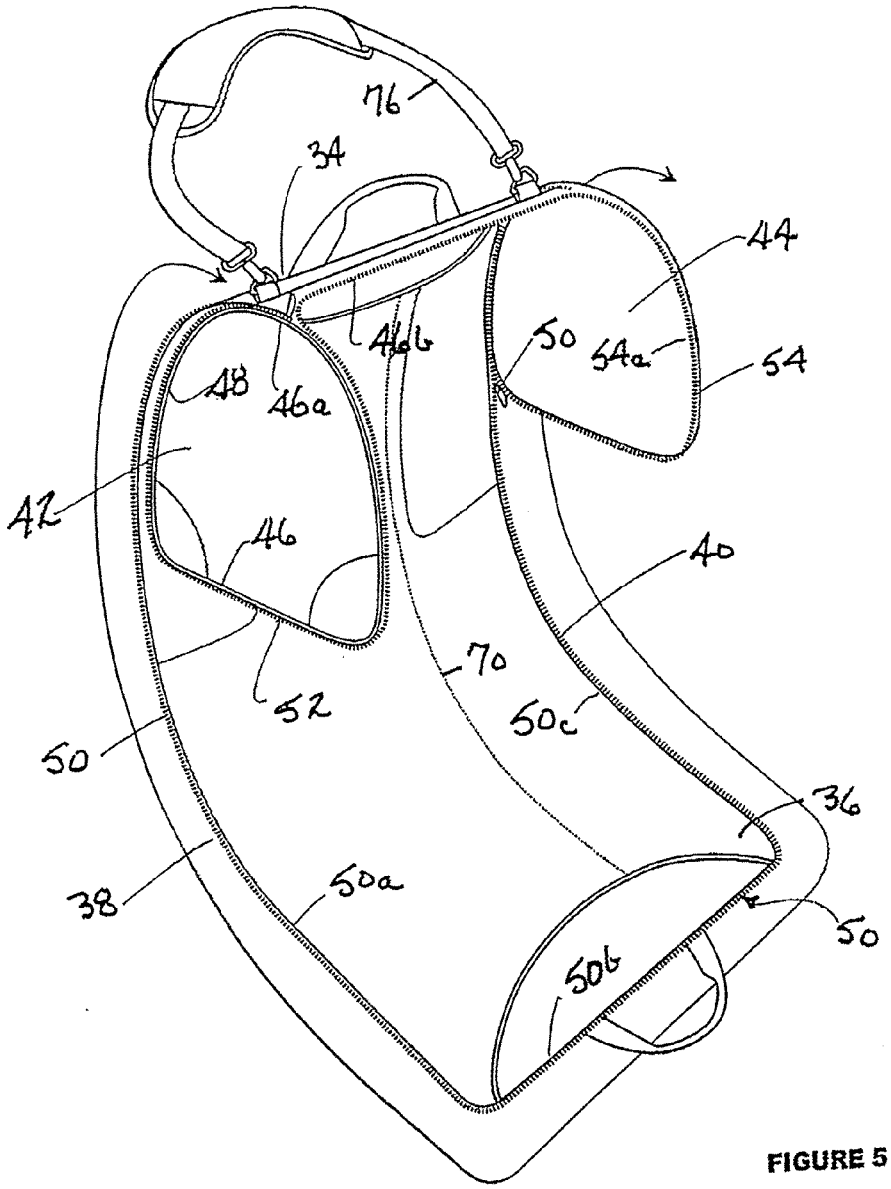
FIG. 5 is an isometric view depicting the duffle bag as it is converted into a garment bag by detaching the peripheral fasteners associated with the duffle end panels.
Figure 6:
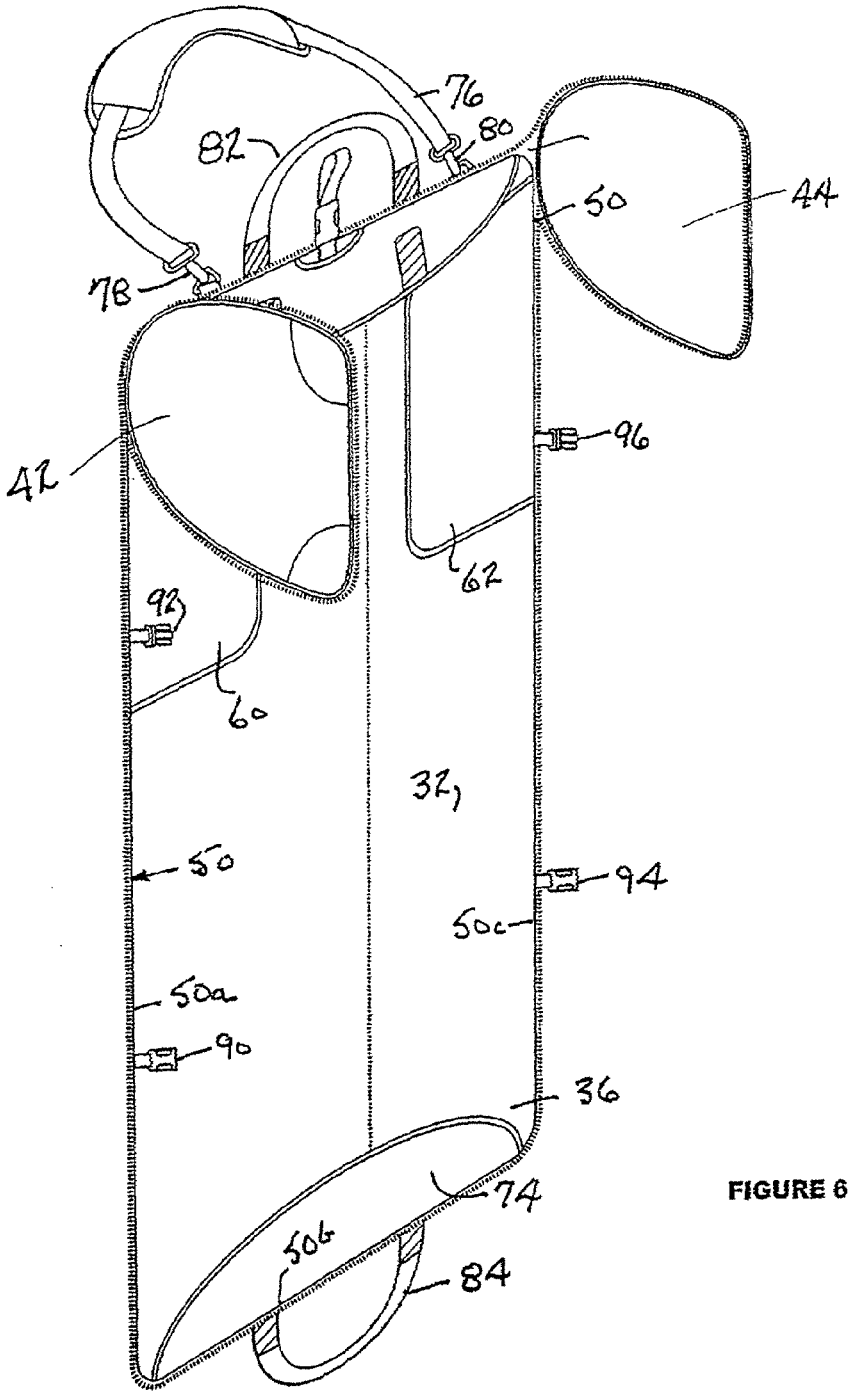
FIG. 6 is an enlarged isometric view of the garment bag wherein the end panels have been released or detached from the lateral side edges of the garment bag.
Figure 7:
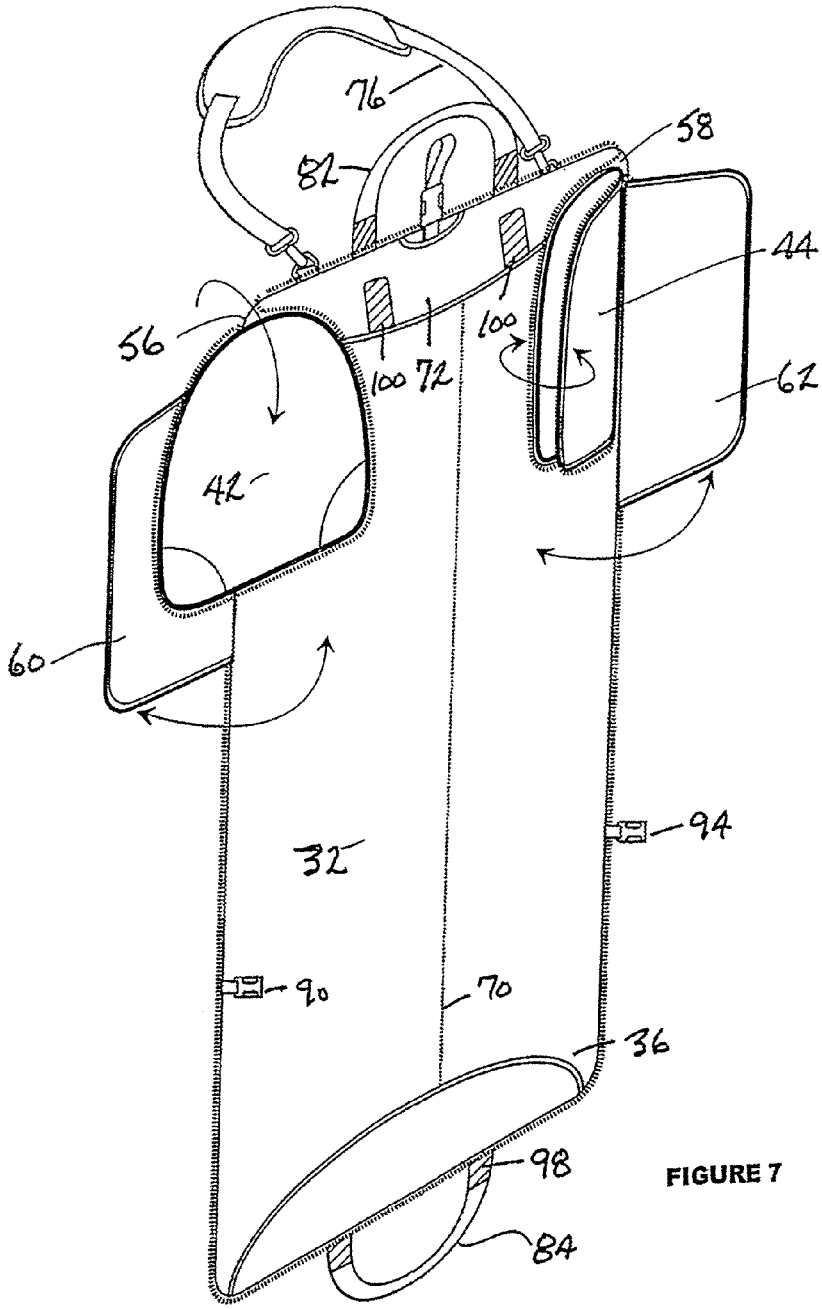
FIG. 7 is an isometric view of the bag construction of FIG. 6 depicting the manner in which the end panels are placed in a storage position.
Figure 8:
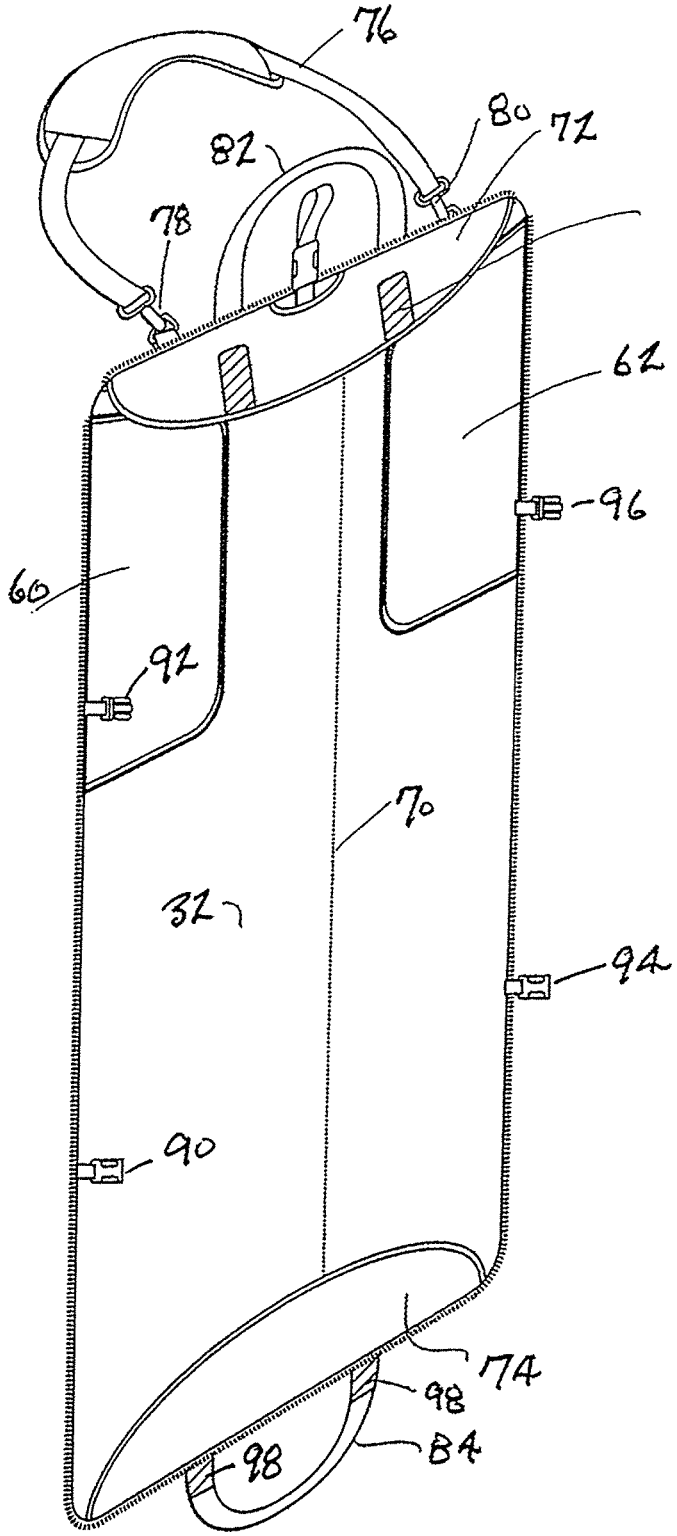
FIG. 8 is an isometric view depicting full conversion of the duffle bag form of the invention to the garment bag form by virtue of storage of the duffle bag end panels.

As illustrated, for example, in FIGS. 5 and 6, the zipper or fastener 50 may be closed to configure the luggage item as depicted in FIGS. 1–4. The fastener 50 may be unfastened in steps as depicted, for example, in FIG. 6 to reveal a garment bag with the duffle end panels 42 and 44 attached respectively by flexible hinge sections 56 and 58. The flexible hinge sections 56, 58 are typically fabric sections which enable the duffle end panels 42 and 44 to be folded flush against the inside panel 32 as depicted in FIG. 7. The duffle end panels or sections 42 and 44 may be flexible themselves and may be folded, for example, as depicted in FIG. 7 wherein the duffle end panel 44 is folded upon itself.

Separate flaps 60 and 62 are affixed to the outside edges of the juncture of the garment bag panels 30 and 32. Those flaps 60 and 62 may be folded as depicted, for example, in FIG. 8 to retain the duffle end panels 42 and 44 flush or tightly against the inside panel 32. In the preferred embodiment, the flaps 60 and 62 may be attached to the inside panel 32 by various means including a hook and loop fastener, snap fasteners and other types of fastener devices. Once the flaps 60 and 62 are engaged in a manner to hold the duffle end panels 42 and 44 flush against the inside panels 32 of the garment bag assembly, the garment bag may be accessed easily through a center opening 70.

In the preferred embodiment the garment bag portion includes an upper flap 72 along the top side and a lower flap 74 along the bottom side. The flaps 72 and 74 fit over and may be fastened to the inside panel 32 to facilitate holding the inside panel tightly closed. A carry strap 76 having its opposite ends 78 and 80 attached by buckles to the top side of the garment bag enables the garment bag to be carried thereon. A first handle 82 may be attached to the outside panel 30 along the top side 34. A second carry handle 84 may be attached to the outside panel 30 or at the junction of the outside of inside panels 30 and 32 along the bottom side.

Figure 9:
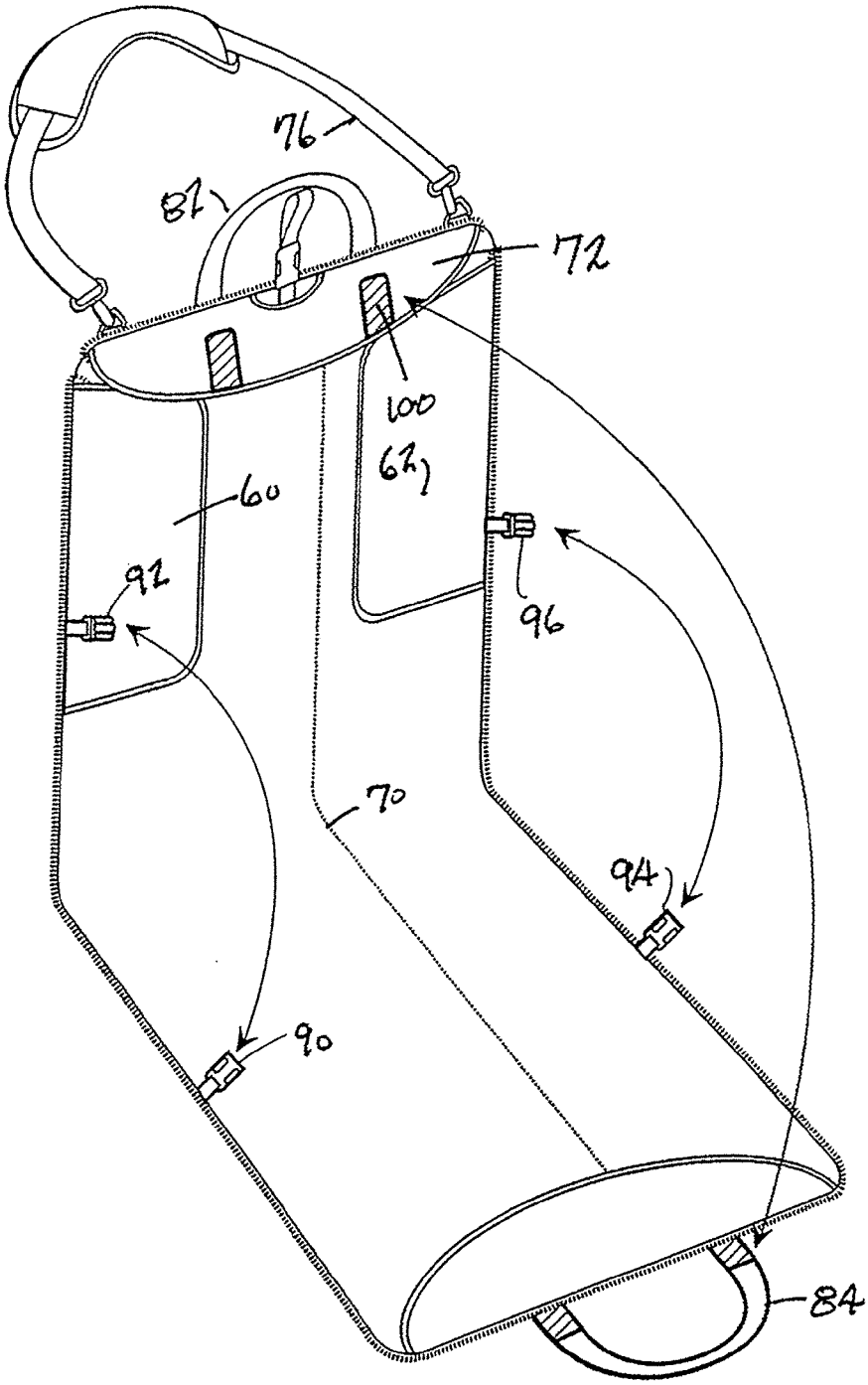
FIG. 9 is an isometric view depicting various features of the garment bag version of the invention.
Figure 14:
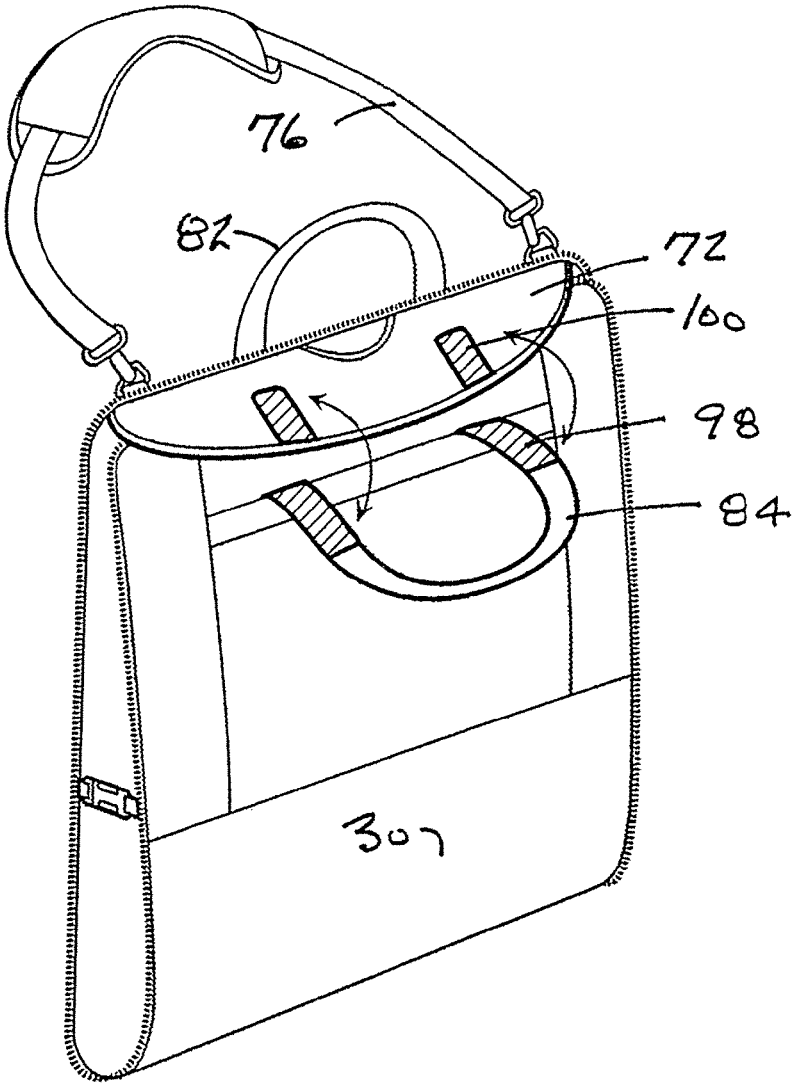
FIG. 14 is an isometric view depicting the garment bag form of the luggage item wherein the garment bag is folded.
Figure 15:
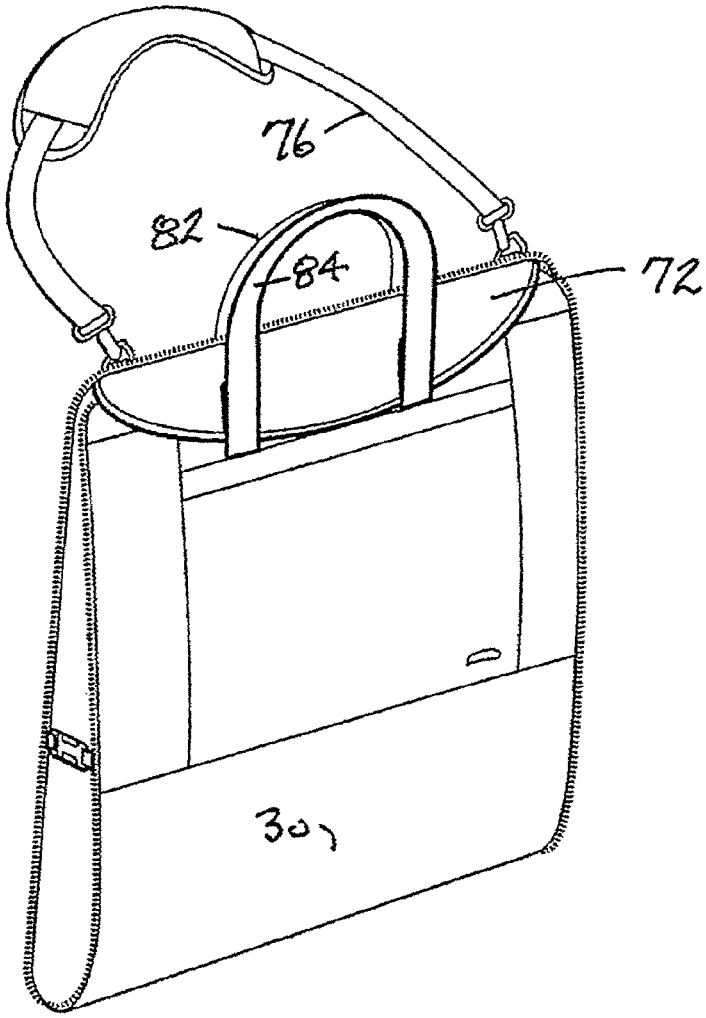
FIG. 15 is an isometric view of the folded garment bag of FIG. 14.

The lateral sides 38 and 40 of the garment bag form of the bag may include clips or buckles 90, 92, 94 and 96 as depicted in FIG. 9 which can be joined together to hold the garment bag in a folded condition with the inside panel 32 divided roughly into equal parts wherein the parts are in opposed relation. The lower handle 84 may include a hook and loop fastener 98 which cooperates with a cooperative hook and loop fastener panel 100 on the outside of the upper flap 72 to facilitate maintaining the garment bag in a closed condition, for example, as depicted in FIGS. 14 and 15.

Figure 2:
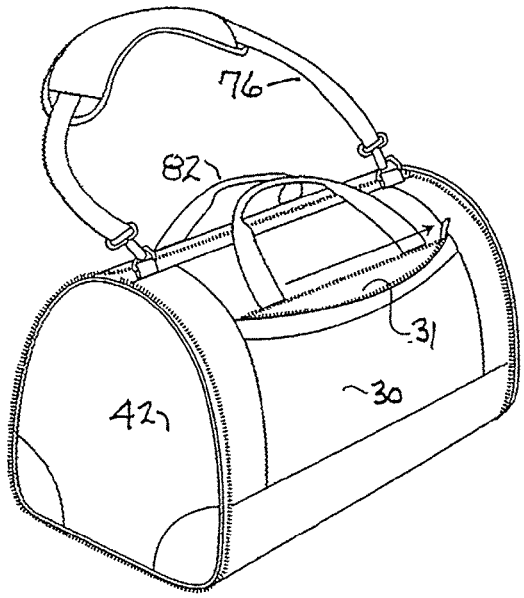
FIG. 2 is the luggage item of the invention in an isometric view wherein the form of the luggage item is that of a duffle bag having an opening for an auxiliary handle.
Figure 3:
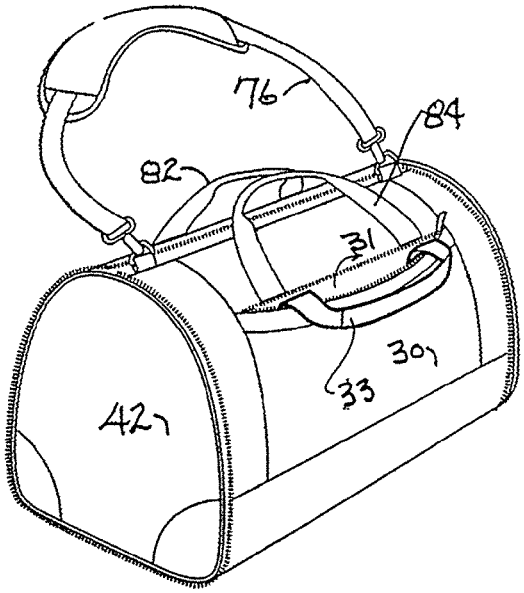
FIG. 3 is an isometric view similar to FIG. 2 depicting the duffle bag form of the luggage item and depicting further an auxiliary handle.
Figure 16:
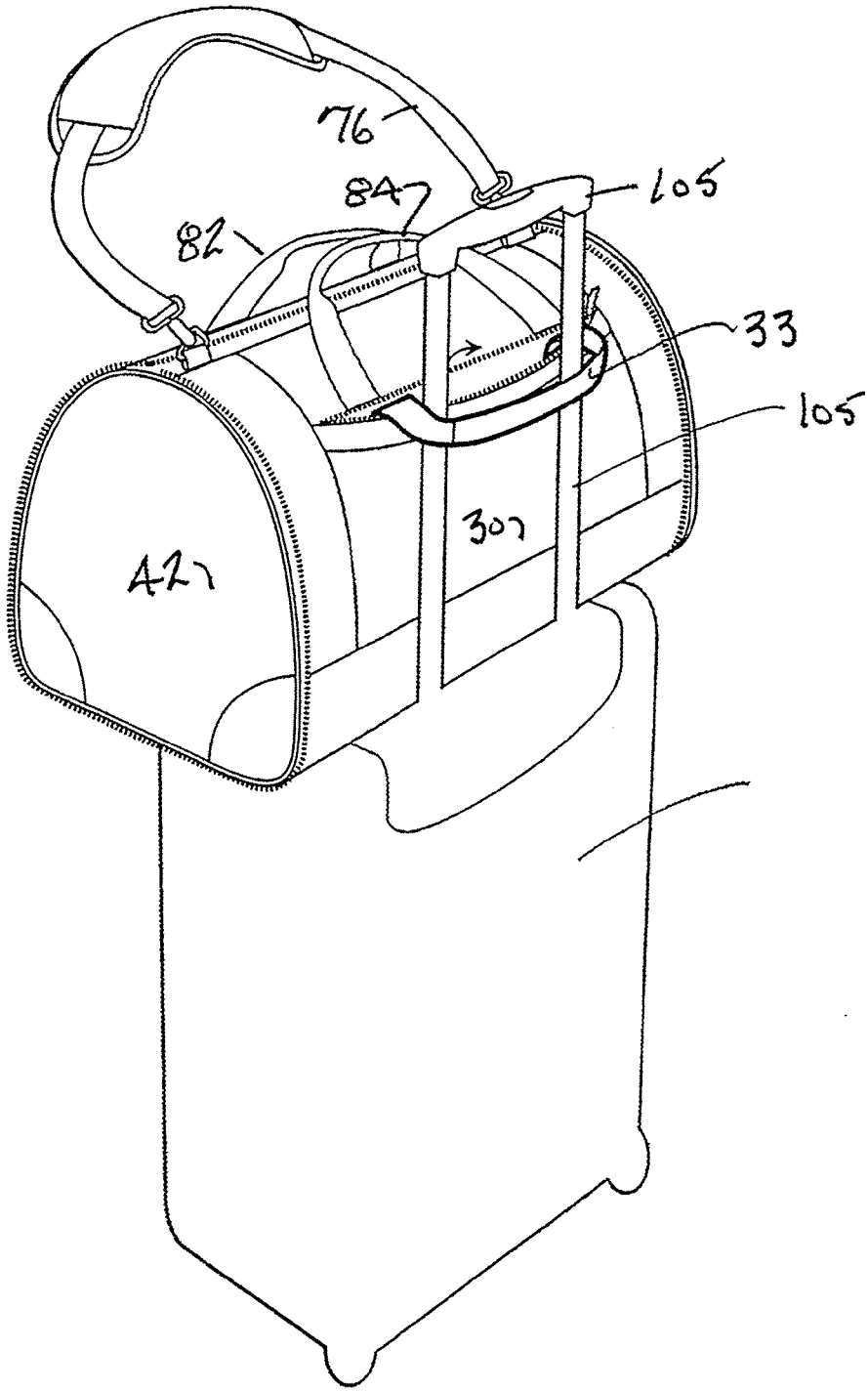
FIG. 16 is an isometric view depicting the luggage item of the invention in the duffle bag form wherein an auxiliary handle is used in combination with a case having a telescoping handle and wheels and further depicting the manner in which the two may be combined for ease of transport.
Figure 17:
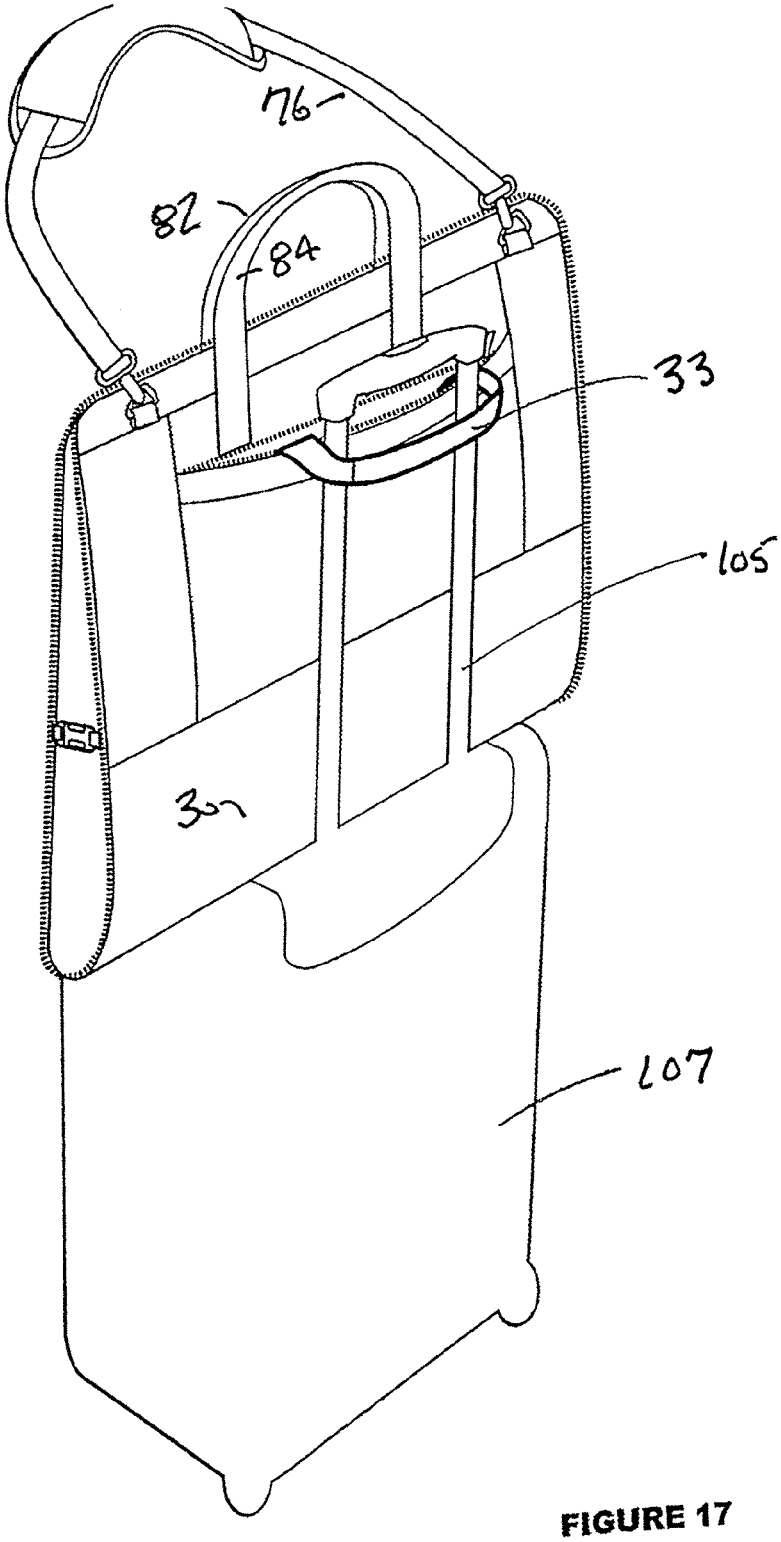
FIG. 17 is an isometric view of the luggage item wherein the item is in the form of a garment bag and further depicting the manner in which it may be combined for transport by a luggage item having wheels and a telescoping handle.
Figure 18:
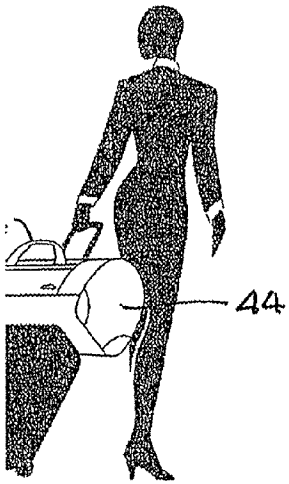
FIGS. 18, 19, 20, 21, 22, and 23 depict the luggage item of the invention in its various useful modes and the manner in which it may be utilized in each of those modes.
Figure 20:
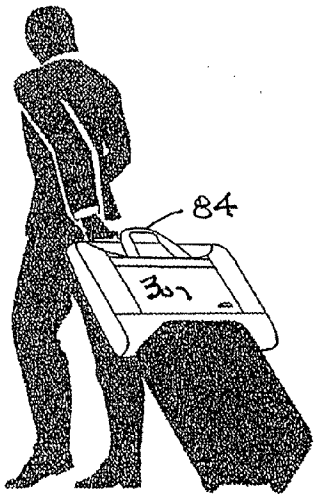

The luggage item includes various additional features which facilitate the usefulness thereof. For example, as depicted in FIGS. 2 and 3, the outside panel 30 includes a pocket 31 into which an auxiliary handle 33 may be stored. Thus as depicted, for example, in FIGS. 16 and 17, the auxiliary handle 33 may be used in combination with a telescoping handle of a wheeled case 107; namely, telescoping handle 105 to facilitate holding the bag in the duffle form on the case 107. In FIG. 17 it is depicted that the auxiliary handle 33 has utility in combination with a telescoping handle 105 of a wheeled luggage item or case 107. FIGS. 18 and 20 further illustrate this utilization of the auxiliary carry handle 33. It is to be noted, however, that the handle 84 may serve a similar function.

FIG. 4 illustrates a manner of construction of a duffle end panel, for example, the end panel 42. Thus, the duffle end panel 42 may be comprised of an outer layer of fabric material; namely, an outer layer 43 which is sewn to an inner layer 45 with a binding 47 at the juncture and wherein a zipper may be attached at the seam which joins the inner panel 43, binding 47 and outer panel 45. Preferably, a cushion material 49 is inserted between the panels 43 and 45 to provide some structural integrity and cushioning effect. For example, a foldable polyethylene or polypropylene foamed board or sponge material may be utilized.

Figures 10, 11, 12, 13:
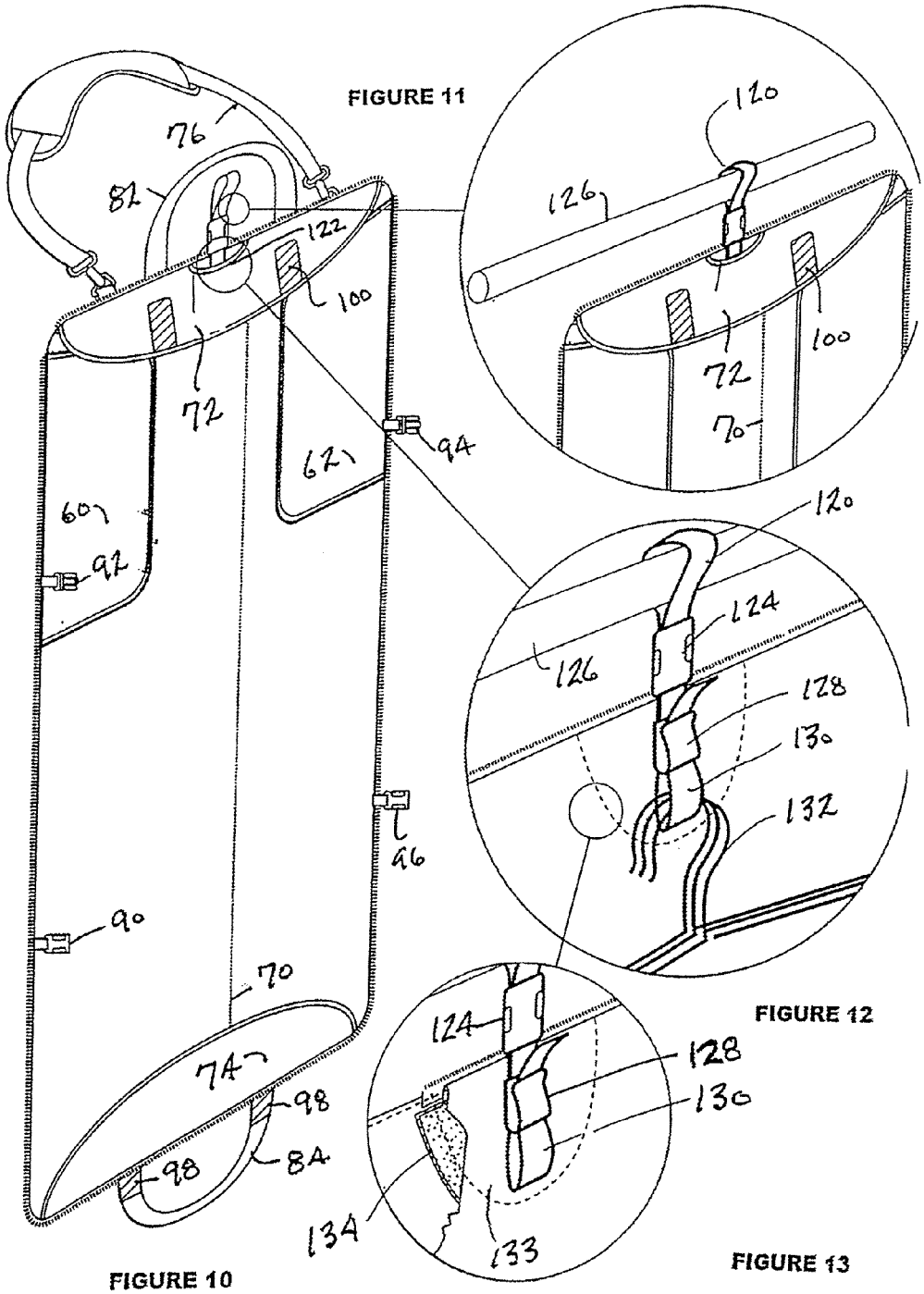
FIG. 10 is an isometric view depicting further features of the garment bag form of the invention as fully depicted in enlarged FIGS. 11, 12, and 13.
FIG. 11 is an enlarged isometric view depicting the garment bag form of the invention and the manner in which it is used for being hung from a bar or pole.
FIG. 12 is an isometric view depicting the manner in which the duffle bag form of the invention may be used for supporting items on hangers.
FIG. 13 is an enlarged isometric partial view depicting the construction of the hanger holder depicted in FIG. 12.

FIGS. 10–13 illustrate some additional features of the invention. A carry binding strap 120 is affixed to the inside of the panels 32 and/or 30. The strap 120 fits through an opening 122 at the top side. The carry strap includes a buckle 124 which enables placement of the strap around a bar 126. The strap 120 further includes an interior buckle 128 which forms a loop 130 in the strap 120 so that hangers 132 may be supported within the garment bag panels 30 and 32. As depicted in FIG. 13, the strap 120 may include a cushion section 133 formed by a protective layer of sponge material 134 that fits over the hanger and loop 130.

Figure 19:
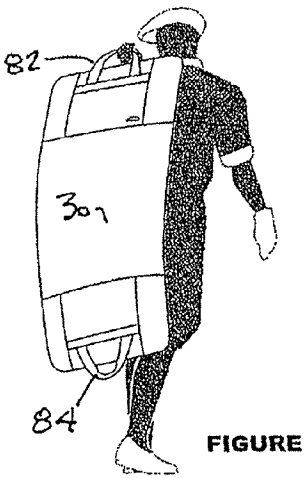
Figure 21:
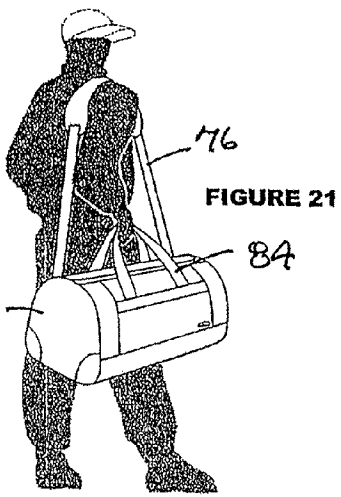
Figure 22:
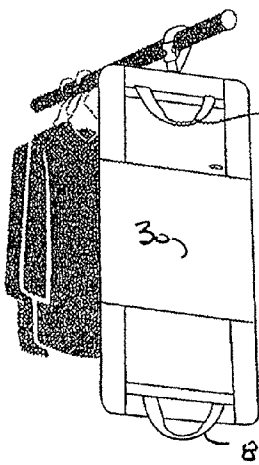
Figure 23:
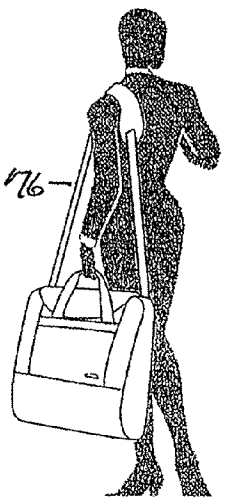

FIGS. 18–23 illustrate the utility of the combination duffle bag and garment carrier. For example, as depicted in FIG. 18 and as previously described, the luggage item may be configured in the form of a duffle and used in combination with a telescoping handle. FIG. 19 depicts the manner of opening of the luggage item in the form of a garment bag which may be easily carried. FIG. 20 illustrates the manner in which the garment bag version or form of the invention may be used in combination with a telescoping wheeled bag. FIG. 21 illustrates the form of the luggage item as a duffle with the shoulder strap used to carry the duffle. FIG. 22 depicts the manner in which the garment bag form may be placed upon a carry bar. FIG. 23 is similar to FIG. 21. However, the bag is in the form of a garment bag carried on the shoulder of an individual.

While there has been set forth a preferred embodiment of the invention, it is to be understood that the invention is to be limited only by the following claims and equivalents thereof.

What is claimed is:

1. Luggage convertible from a duffle bag form to a garment bag form and vice versa comprising, in combination:

a garment configured bag including an outside panel and inside panel affixed to the outside panel to form a garment bag enclosure, said inside and outside panels having a generally rectangular configuration with a top side, first and second lateral, spaced sides, a bottom side and including a peripheral edge, a left side junction of the top side and first lateral side, and a right side junction of the top side and second lateral side;

a first duffle end panel:

a second duffle end panel;

said first end panel having a peripheral edge and a top joined to the left side junction;

said second end panel having a peripheral edge and a top joined to the right side junction;

a peripheral fastener for joining the first lateral side peripheral edge to the first duffle end panel peripheral edge, said first lateral side panel peripheral edge substantially equal in length to the peripheral edge of the first end panel; and a peripheral fastener for joining the second lateral side peripheral edge to the second duffle and panel, said second lateral side panel peripheral edge substantially equal in length to the peripheral edge of the second end panel, whereby joinder of the end panels to the garment bag by said peripheral fasteners forms a duffle bag with the garment bag inside panel on the inside of the duffle bag;

said first and second end panels joined respectively to the left side junction and the right side junction by a flexible connection enabling folding of the first and second end panels generally against the inside panel and wherein at least one of said end panels is capable of being folded upon itself.

2. The luggage of claim 1 including a fastener for joining the garment bag top side and bottom side.

3. The luggage of claim 1 including a single peripheral edge fastener for joining the first lateral side to the first end panel, the bottom side to the top side and the second lateral side to the second end panel.

4. The luggage of claim 1 wherein the first end panel and second end panel are substantially congruent in shape.

5. The luggage of claim 1 wherein the garment bag inside panel includes an ingress opening to an enclosure defined between the inside panel and outside panel.

6. The luggage of claim 1 further including at least one end panel retention member for retaining one end panel generally against the inside panel.

7. The luggage of claim 6 wherein the retention member comprises a flexible flap attached adjacent a lateral side and foldable over the retained end panel.

8. The luggage of claim 1 including a handle on the outside panel adjacent to top.

9. The luggage of claim 1 including first and second handles on the outside panel adjacent respectively the top and the bottom.

10. The luggage of claim 1 including a flap along the top side flexibly hinged to the top side.

11. The luggage of claim 10 further including a handle affixed to the outside panel on the bottom side said handle attachable to the flap to retain the panels folded over one another with the top side and bottom side placed in opposed relation.

12. The luggage or claim 1 further including auxiliary fasteners along the peripheral side edges or the lateral side panels connectable to retain the lateral side panels in folded relation with the inside panel comprised of opposed facing sections as the top and bottom are maintained in generally opposed relation.

13. The luggage of claim 1 further including a luggage support member at the top side of the panels with the enclosure defined by the panels.

14. The luggage of claim 1 further including a carry strap attached to the outside panel at the top side.

15. The luggage of claim 1 including first and second handle straps on the outside panel at the top side and, bottom side respectively.

16. The luggage of claim 1 wherein the duffle end panels have a profile with a generally straight bottom edge and an arcuate top edge.

17. The luggage of claim 1 wherein the peripheral faster comprises a zipper device.

18. The luggage of claim 17 wherein the zipper device comprise a single continuous zipper device.

19. The luggage of claim 1 including a carry strap on the outside panel at the top side, a first carry handle on the outside panel at the top side and a second carry handle on the outside panel at the bottom side.

20. The luggage of claim 19 further including a secondary handle on the outside panel at the bottom side.

21. The luggage or claim 19 further including an attachment mechanism positioned between the top side and bottom side for connecting the first and second lateral side edges when the panels are folded over each other.

22. The luggage claim 19 further including a first auxiliary flap hinged at the top side of the inside panel and a second auxiliary flap hinged at the bottom side of the inside panel.

23. Luggage convertible front a duffle bag form to a garment bag form and vice versa, comprising, in combination:

a garment configured bag including an outside panel and inside panel affixed to the outside panel to from a garment hag enclosure, said inside and outside panels having a generally rectangular configuration with a top side, first and second lateral, spaced sides, a bottom side and including a peripheral edge a left side junction of the top side and first literal side, and a right side junction of the top side and second lateral side:

a first duffle end panel;

a second duffle end panel;

said first end panel having a peripheral edge and a top joined to the left side junction;

said second end panel having a peripheral edge and a top joined to the right side junction;

a peripheral fastener for joining the first lateral side peripheral edge to the first duffle end panel peripheral edge, said first lateral side panel peripheral edge substantially equal in length to the peripheral edge of the first end panel;

a peripheral fastener for joining the second lateral side peripheral edge to the second duffle and panel said second lateral side panel peripheral edge substantially equal in length to the peripheral edge of the second end panel, whereby joinder of the end panels to the garment bag by said peripheral fasteners forms a duffle bag with the garment bag inside panel on the inside of the duffle bag said first and second end panels joined respectively to the left side junction and the right side junction by a flexible connection enabling folding of the first and second end panels generally against the inside panel; and at least one end panel retention member for retaining one end panel generally against the inside panel, said retention member comprising a flexible flap attached adjacent a lateral side and foldable over the retained end panel.

24. The luggage of claim 23 including a single peripheral edge fastener for joining the first lateral side to the end panel, the bottom side to the top side and the second lateral side to the second end panel.

25. Luggage convertible from a duffle bag form to a garment bag form and vice versa comprising, in combination:

a garment configured bag including an outside panel and inside panel affixed to the outside panel to form a garment bag enclosure said inside and outside panels having a generally rectangular configuration with a top side first and second lateral, spaced sides, a bottom side and including a peripheral edge a left side junction of the top side and first lateral side, and a right side junction of the top side and second lateral side:

a first duffle end panel;

a second duffle end panel;

said first end panel having a peripheral edge and a top joined to the left; side junction;

said second end panel having a peripheral edge and a top joined to the right side junction;

a peripheral fastener for joining the first lateral side peripheral edge to the first duffle end panel peripheral edge said first lateral side panel peripheral edge substantially equal in length to the peripheral edge of the first end panel:

a peripheral fastener for joining the second lateral side peripheral edge to the second duffle and panel, said second lateral side panel peripheral edge substantially equal in length to the peripheral edge of the second end panel, whereby joinder of the end panels to the garment bag by said peripheral fasteners forms a duffle bag with the garment bag inside panel on the inside of the duffle bag:

a flap along the top side flexibly hinged to the top side; and a handle affixed to the outside panel on the bottom side said handle attachable to the flap to retain the panels folded over one another with the top side and bottom side placed in opposed relation.

26. The luggage claim 25 including a single peripheral edge fastener for joining the first lateral side to the first end panel, the bottom side to the top side and the second lateral side to the second end panel.

* * * * *